US008556684B2

(12) United States Patent
Sather et al.

(10) Patent No.: US 8,556,684 B2
(45) **Date of Patent: *Oct. 15, 2013**

(54) RETAINING RING FOR CHEMICAL MECHANICAL POLISHING

(71) Applicant: SPM Technology, Inc., Georgetown, TX (US)

(72) Inventors: William B. Sather, Austin, TX (US); Adam W. Manzonie, Gilbert, AZ (US)

(73) Assignee: SPM Technology, Inc., Georgetown, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/770,345

(22) Filed: Feb. 19, 2013

(65) Prior Publication Data

US 2013/0165028 A1 Jun. 27, 2013

Related U.S. Application Data

(63) Continuation of application No. 12/560,920, filed on Sep. 16, 2009, now Pat. No. 8,517,803.

(51) Int. Cl.
*B24B 7/22* (2006.01)

(52) U.S. Cl.
USPC ..... 451/285; 451/286; 451/287; 451/288

(58) Field of Classification Search
USPC ..... 451/285–290
See application file for complete search history.

(56) References Cited

U.S. PATENT DOCUMENTS

| | | | | |
|---|---|---|---|---|
| 2007/0224864 | A1* | 9/2007 | Burns et al. | 439/164 |
| 2008/0196833 | A1* | 8/2008 | Chen et al. | 156/345.14 |
| 2010/0041323 | A1* | 2/2010 | Burns et al. | 451/398 |
| 2011/0151755 | A1* | 6/2011 | Burns et al. | 451/286 |

OTHER PUBLICATIONS

Heli-Coil materials sheet, 2012, filed in U.S. Appl. No. 12/560,920.*

* cited by examiner

*Primary Examiner* — Maurina Rachuba
(74) *Attorney, Agent, or Firm* — William D. Wiese; Dubois, Bryant & Campbell LLP

(57) ABSTRACT

An improved retaining ring used for chemical mechanical polishing of substrates, such as semiconductor wafers, to hold a substrate in place during the polishing process. The retaining rings are configured with inserts through which fasteners are positioned to securely affix the retaining ring to the polishing head. The inserts assist in dissipating the force of the fasteners, thereby allowing a more uniform polishing surface. The opening through which the fastener is positioned may be configured with concave or convex side walls to assist in dissipating the force of the fasteners during installation of the retaining ring or the polishing process.

8 Claims, 4 Drawing Sheets

RETAINING RING FOR CHEMICAL MECHANICAL POLISHING

CROSS-REFERENCE TO RELATED APPLICATIONS

This utility application is a continuation application claiming priority based upon prior U.S. Utility patent application Ser. No. 12/560,920 filed Sep. 16, 2009, entitled "Retaining Ring for Chemical Mechanical Polishing," the disclosure of which is fully incorporated herein by this reference as if fully set forth herein in its entirety.

BACKGROUND OF THE INVENTION

This invention relates to polishing of substrates, and more particularly to retaining ring apparatus for retaining a substrate during polishing. More specifically, this invention relates to an improved retaining ring which allows for the secure attachment to a carrier head without introducing undesirable materials into the polishing environment and with minimal or no deformation at or near the fastener locations.

Chemical mechanical polishers are used in several applications including the manufacture of integrated circuits where they provide the silicon wafer substrates with a smooth flat finish during the deposition of conductive, semi-conductive and/or insulative layers. The semiconductor wafer is placed on a carrier head which holds the wafer using a combination of vacuum suction or other means to contact the rear side of the wafer.

A retaining ring around the edge of the wafer retains the wafer on the carrier head. The front side of the wafer is then contacted by a rotating polishing pad that polishes the outermost surface of the wafer to a flat smooth surface. During the polishing, the carrier head and retaining ring assembly press against the substrate and the rotating polishing pad. The movement of the polishing pad across the surface of the substrate causes material to be mechanically and chemically removed from the face of the substrate.

In the polishing of semiconductor wafers, it is important that the equipment and materials used in the process, including the retaining ring and the materials used in the retaining ring, are compatible with each other and with the chemical and material constraints inherent to the semiconductor device. Those skilled in the art recognize that a silicon wafer with partially constructed devices, such as memory chips or microprocessors, are inherently vulnerable to negative chemical processes such as corrosion, electrostatic emission, physical damage by contact with foreign objects, contamination with foreign materials from equipment component wear and degradation, by-products from chemicals and materials used in processes, and other dilatory factors and processes inherent in chemical mechanical processing.

When polishing conductive materials such as tungsten, copper, conductive polymers, and the like, the process environment must be controlled to minimize the propensity of high-purity metals to degrade when exposed to surface contamination. One method of minimizing such contamination is the use of materials that are not chemically reactive in the construction of the polishing equipment. Because the polishing of conductive materials generally involves using chemicals that react with metal surfaces, it is desirable to minimize or eliminate exposure of any metallic components in the chemical mechanical polishing environment. Historically, this has partially accomplished by constructing components of the equipment from specially designated plastics that are non-reactive but provide near-metallic strength. This method has been successful where, for example, the physical properties of the plastics, such as the heat stability, durability, ability to withstand friction, etc., were suitable substitutes for metal in the polishing process and equipment. Where the substitution of plastic for metal has not sufficed, it has been necessary to design processes that allow for some inherent contamination during processing.

While the problems inherent in polishing conductive materials seem apparent, there are also significant difficulties in polishing non-conductive materials such as doped oxide materials, including tetraethyl orthosilicate (TEOS), borophosphosilicate glass (BPSG), and other layers deposited using chemical vapor deposition, electrodeposition, epitaxy and other deposition methods. As a result, the process environment must also be controlled during the polishing of these materials.

While non-conductive materials tend to be more stable than conductive materials, they are nonetheless subject to damage during processing, including surface damage, contamination by contact with foreign matter, chemical contamination and ionic contamination. In the case of ionic contamination, for example, the non-conductive layers, particularly those involving device isolation processes such as those occurring early in the semiconductor device creation process, must not be exposed to ionizing materials such as sodium, potassium, and the like These ions, sometimes called mobile ions, are extremely detrimental to semiconductor devices. To limit the exposure of the wafer surface to mobile ions, the process space is, where possible, constructed of materials that do not react to the chemicals used during processing. For example, when polishing non-conductive material, basic or high pH chemicals are typically used. Ideally, the chemical mechanical processing area would not have any exposed metallic equipment due to the inherently reactive nature of metallic materials to non-conductive polishing chemicals.

It would be highly desirable to provide a one-piece retaining ring assembly for use in chemical mechanical polishing which did not introduce undesirable materials into the polishing environment so as to limit the exposure of the wafer surface to mobile ions, while at the same time being sufficiently rigid to be used as a substitute for existing chemical mechanical polishing applications. The result would be a significant improvement in the overall polishing process. The ring assembly of the present invention obtains these results.

SUMMARY OF THE INVENTION

In one aspect, the invention is directed to a retaining ring having a generally annular body with an upper portion, a lower portion, an inner portion, and an outer portion. The upper surface includes a series of grooves into which inserts are affixed. The inserts are made of materials that generally deform less than the material from which the retaining ring is made. When positioned in the retaining ring and affixed to the carrier head, the inserts do not come into contact with the chemicals used during process. The insert can be a variety of configurations, each of which includes an opening through which a fastener may pass to attach the retaining ring to a carrier head. In some embodiments, the side walls of the opening are convex or concave to assist in the dissipation of the force conveyed through the fastener during installation and the polishing process.

The foregoing has outlined rather broadly certain aspects of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures or processes for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION OF THE EMBODIMENTS

The present invention provides an improved retaining ring used in chemical mechanical polishing. The making and using of the presently preferred embodiments are discussed in detail below. It should be appreciated, however, that the present invention provides many applicable inventive concepts that can be embodied in a wide variety of specific contexts. The specific embodiments discussed are merely illustrative of specific ways to make and use the invention, and do not limit the scope of the invention.

Figure 1A:
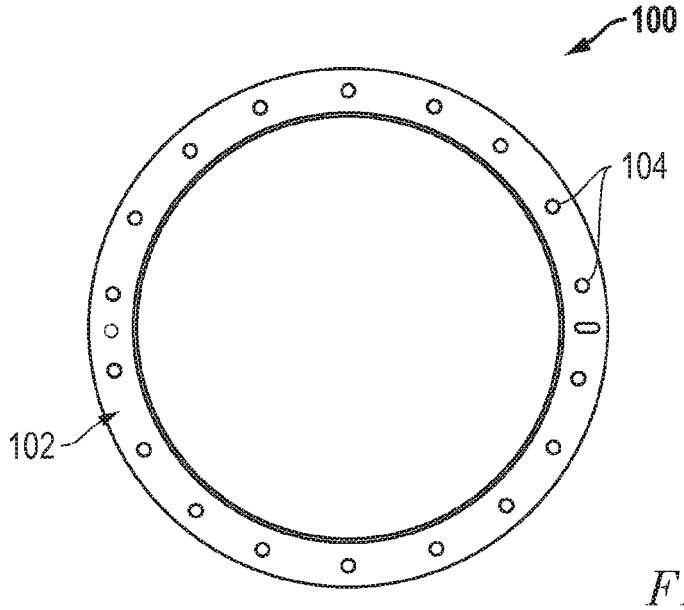
FIG. 1A shows a top view of a retaining ring of the prior art.
Figure 1B:
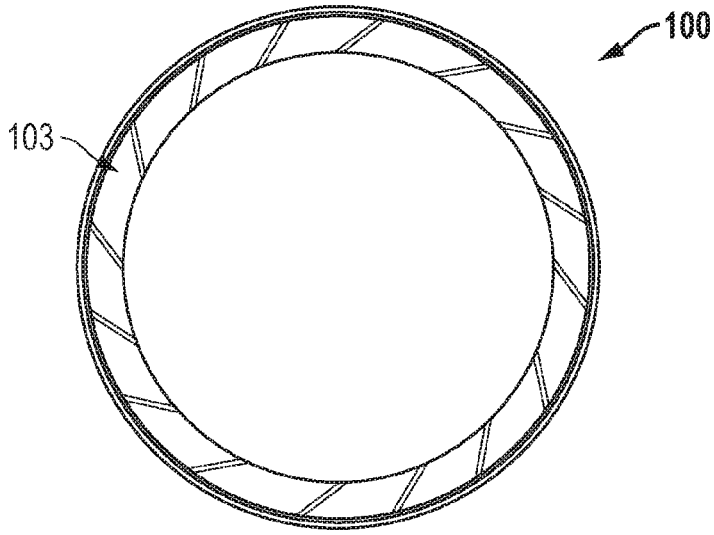
FIG. 1B shows a bottom view of a retaining ring of the prior art.
Figure 1C:
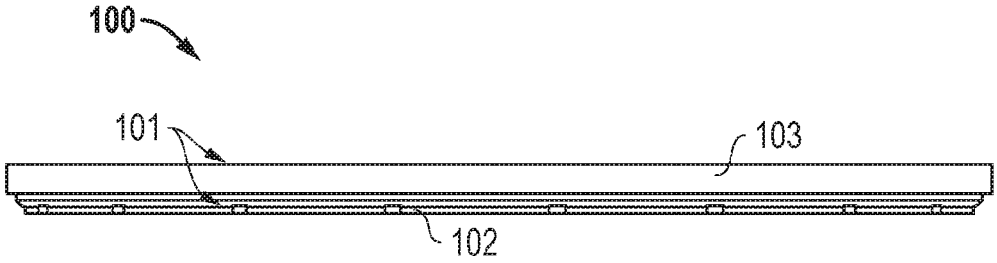
FIG. 1C shows a lateral view of a retaining ring of the prior art.

Referring now to FIG. 1 which shows a retaining ring commonly known in the art. This two-part retaining ring 101 has an upper portion 102 with holes 104 used to affix retaining ring 101 to a chemical mechanical polishing head (not shown). Upper portion 102 is typically made of stainless steel or other metals which provide rigidity to accommodate the stresses of the chemical mechanical polishing process. Although certain metals can provide rigidity, they are typically undesirable because they react to the chemicals used in the chemical mechanical processing process. For example, certain metals degrade when exposed to basic and acidic chemicals used in processing and thereby contaminate the process space. Moreover, when the upper portion 102 is affixed to the lower portion 103 with an adhesive or other bonding material, those particles released from those materials may also contribute to contamination of the process space. All of these contaminants negatively affect the process environment and adversely affect the material or device being polished.

Figure 2:
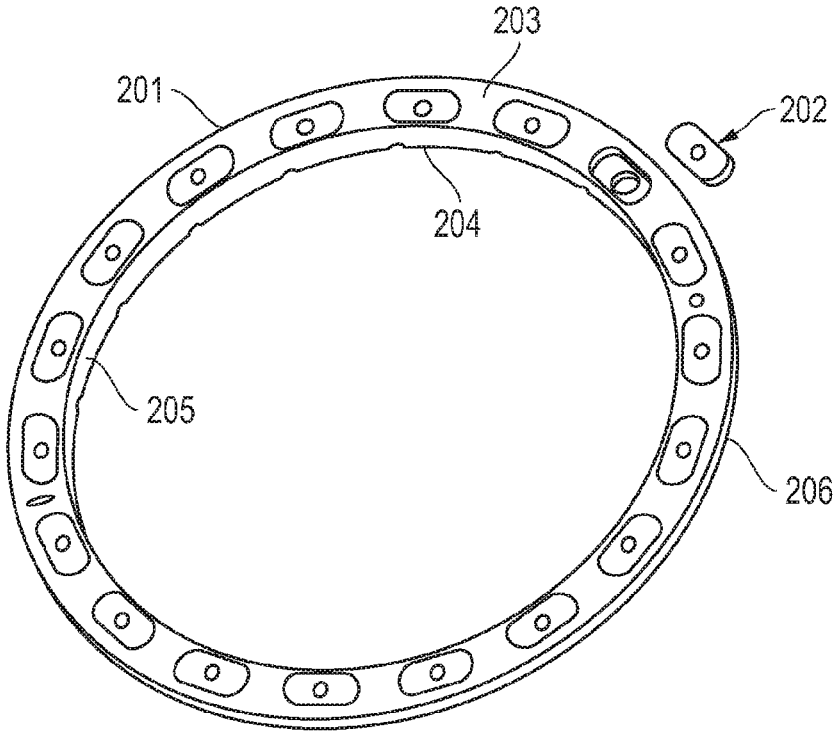
FIG. 2 shows an isometric view of the upper potion of one embodiment of the retaining ring of the present invention.

Referring now to FIG. 2 which shows an isometric view of one embodiment of the retaining ring of the present invention. Retaining ring 201 has a generally annular body having an upper portion 203, a lower portion 204, an inner portion 205 and an outer portion 206. Retaining ring 201 may be made of any plastic material known in the art, such as polycarbonate, polyethylene terpthalate, polyethersulphone, polyetheretherketone, polyphenelynesulfide, and others. The diameter of retaining ring 201 may be any diameter commonly known in the art. The upper portion 203 of retaining ring 201 is configured with a plurality of rigid inserts 202. Inserts 202 may be made from stainless steel or other materials, either metallic or non-metallic, that are more rigid than the material of retaining ring 201. In some embodiments, inserts 202 have parallel sides and semi-circular ends as further described below. Inserts 202 are positioned in the upper portion 203 of retaining ring 201 such that the upper portion 203 of retaining ring 201 is substantially flat and may be readily affixed to a chemical mechanical polishing carrier head. In addition, the location of inserts 202 is such that, when the retaining ring 201 is affixed to a carrier head, inserts 202 do not come into contact with the chemicals used during processing. Moreover, because the material used to make inserts 202 deforms less than the material used to make the remaining portion of retaining ring 201, the deformations near the fasteners used to attach retaining ring 201 to the carrier head are reduced or eliminated resulting in a flatter, smoother surface of retaining ring 201.

Figure 3:
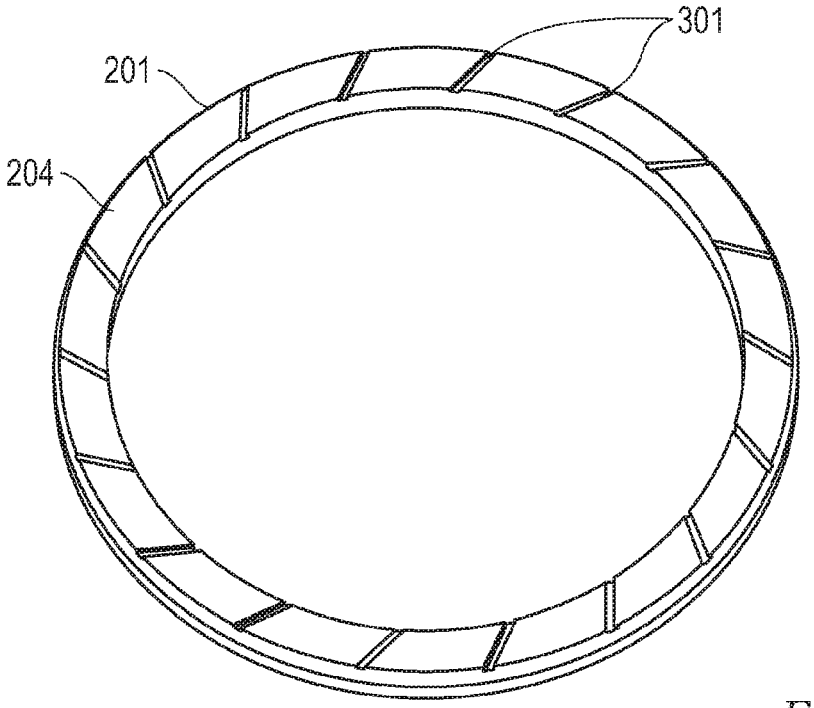
FIG. 3 shows an isometric view of the lower portion of one embodiment of the retaining ring of the present invention.

As shown in FIG. 3, in one embodiment the underside 204 of the retaining ring 201 of the present invention is the same as the underside of other retaining rings known in the art. Because inserts 202 do not penetrate the full depth of retaining ring 201, as further described below, it is possible to machine the underside 204 of retaining ring 201 in any configuration desired. In the configuration shown in FIG. 3, grooves 301 are positioned laterally and diagonally across the underside 204 so that the underside 204 is similar in appearance and function to retaining rings known in the art.

Figure 4:
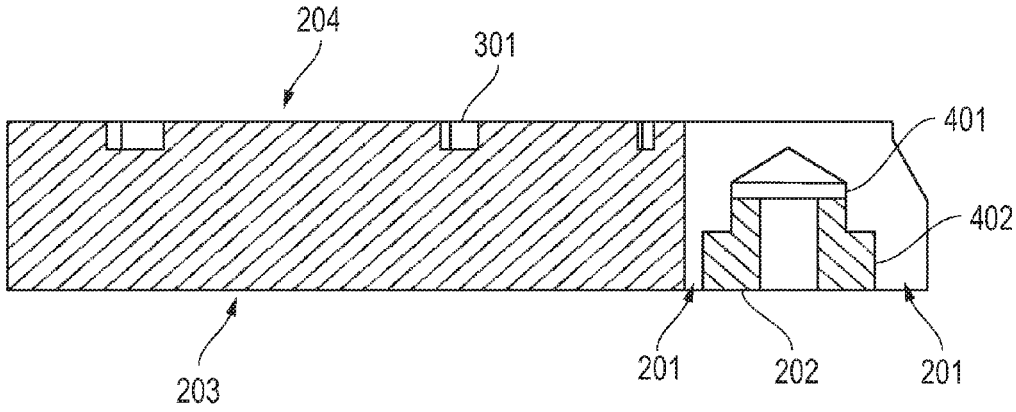
FIG. 4 shows a lateral cross-sectional view of one embodiment of the retaining ring of the present invention.

Referring now to FIG. 4, a cross-sectional view of insert 202 is positioned within retaining ring 201 and fastener 401 is used to affix retaining ring 201 to the carrier head. Insert 202 is positioned in such a manner so as to minimize contact degradation over time. Insert 202 may be positioned such that the frictional forces between the exterior surface of insert 202 at interface 402 and the inner surface of retaining ring 201 at interface 402 is sufficient to affix insert 202 to retaining ring 201. Alternatively, insert 202 could be affixed to retaining ring 201 using one or more techniques know in the art. By way of example, insert 202 could be affixed using adhesives, could be affixed using press-fit interconnectors, could be affixed using injection molding whereby retaining ring 201 is injected molded around inserts 202, could be affixed using overmolding whereby inserts 202 are overmolded into retaining ring 201, or could be affixed using ultrasonic welding techniques.

Figure 5:
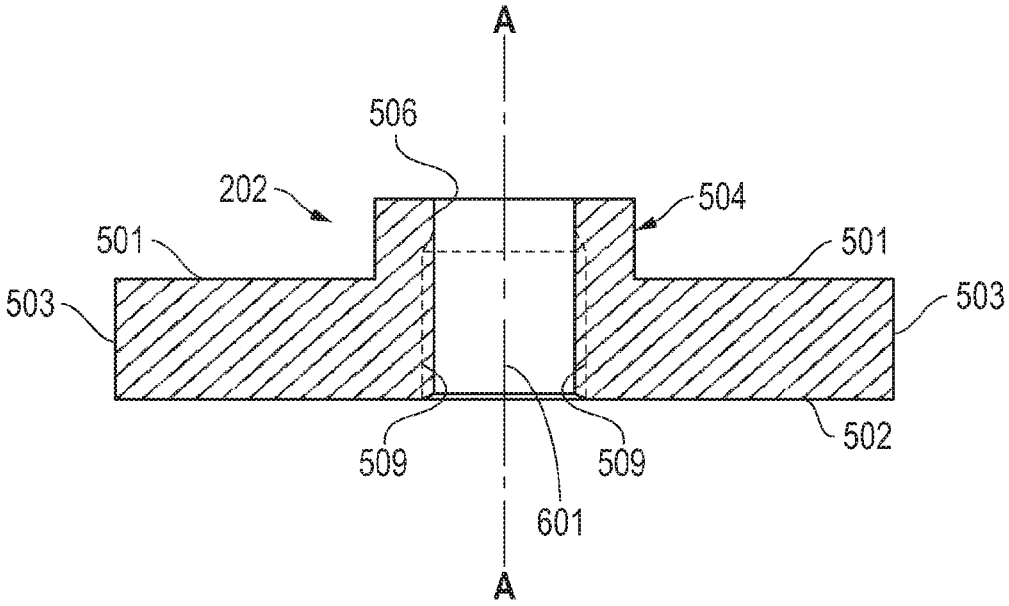
FIG. 5 shows a lateral cross-sectional view of one embodiment of an insert of the present invention.
Figure 6:
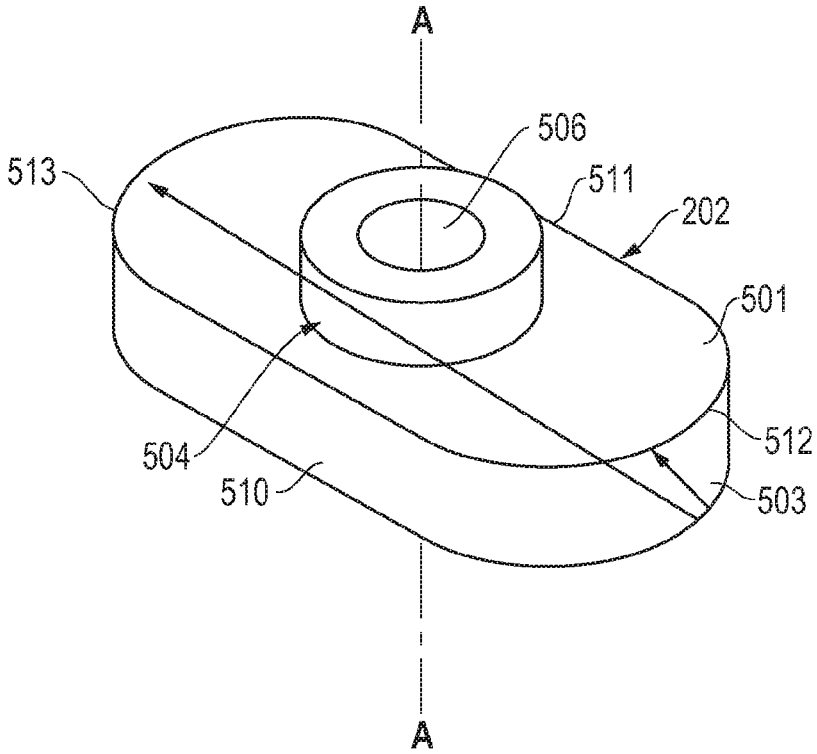
FIG. 6 shows an isometric view of one embodiment of an insert of the present invention.

FIG. 5 and FIG. 6 depict one embodiment of an insert 202 of the present invention. Insert 202 must be configured in a manner that will allow it to be securely affixed to retaining ring 201. In one embodiment, retaining ring 201 is configured with a groove in the approximate shape of insert 202. The main body of insert 202 has a top side 501, a bottom side 502, and an edge 503, the edge 503 configured to create a proximal side 510, a distal side 511, a proximal end 512 and a distal end 513. A portion 504 of insert 202 is raised. An opening 506 is located along axis A-A such that the raised portion 504 is configured cylindrically around the axis A-A and the proximal side 510 and the distal side 511 are approximately equidistant from axis A-A and the proximal end 512 and the distal end 513 are approximately equidistant from axis A-A. In one embodiment, the proximal side 510 and the distal side 511 are parallel and the proximal end 512 and the distal end 513 are each curvilinear to generally from a rectangle with curvilinear ends. As will be appreciated by those skilled in the art, the configuration of insert 202 shown and described herein, and the corresponding groove in retaining ring 201, is only one of many possible configurations. For example, the main body of insert 202 could be generally cylindrical, elliptical, circular other smooth shape or it could be a multisided shape; raised portion 504 could be reduced or eliminated in its entirety; raised portion 504 could be configured as an oval, ellipse, cylinder, or other shapes.

Opening 506 is configured to accommodate a fastener. The sidewalls 509 of opening 506 may be convex or concave to assist in distribution the force applied through opening 506 when a fastener is inserted therethrough.

While the present system and method has been disclosed according to the preferred embodiment of the invention, those of ordinary skill in the art will understand that other embodiments have also been enabled. Even though the foregoing discussion has focused on particular embodiments, it is understood that other configurations are contemplated. In particular, even though the expressions "in one embodiment" or "in another embodiment" are used herein, these phrases are meant to generally reference embodiment possibilities and are not intended to limit the invention to those particular embodiment configurations. These terms may reference the same or different embodiments, and unless indicated otherwise, are combinable into aggregate embodiments. The terms "a", "an" and "the" mean "one or more" unless expressly specified otherwise.

When a single embodiment is described herein, it will be readily apparent that more than one embodiment may be used in place of a single embodiment. Similarly, where more than one embodiment is described herein, it will be readily apparent that a single embodiment may be substituted for that one device.

In light of the wide variety of possible CMP retaining rings, the detailed embodiments are intended to be illustrative only and should not be taken as limiting the scope of the invention. Rather, what is claimed as the invention is all such modifications as may come within the spirit and scope of the following claims and equivalents thereto.

None of the description in this specification should be read as implying that any particular element, step or function is an essential element which must be included in the claim scope. The scope of the patented subject matter is defined only by the allowed claims and their equivalents. Unless explicitly recited, other aspects of the present invention as described in this specification do not limit the scope of the claims.

What is claimed is:

1. A retaining ring for chemical mechanical polishing comprising:

a substantially annular retaining ring having an upper portion, a lower portion, an inner portion and an outer portion; wherein said upper portion is configured with a plurality of grooves wherein each of said grooves is elliptical and said lower portion is adapted to contact a polishing pad and a semiconductor wafer during polishing; and inserts substantially the same shape as said grooves fixably insertable into said grooves, wherein an opening in said inserts allows a fastener to be passed therethrough to secure said retaining ring to a carrier head, and wherein said openings do not penetrate said lower portion;

said insert having a main body portion and a raised portion, said main body portion having a top side, a bottom side, and a main body edge; wherein an opening is located along an axis through said main body portion such that said main body edge is configured elliptically around said axis.

2. The retaining ring of claim 1, wherein said retaining ring is made from polycarbonate, polyethylene terpthalate, polyethersulphone, polyetheretherketone, or polyphenelynesulfide.

3. The retaining ring of claim 1, wherein said insert is made of stainless steel.

4. The retaining ring of claim 1, wherein said insert is made from a material which deforms less during stress than said retaining ring.

5. The retaining ring of claim 1, wherein said insert is affixed in said grooves of said retaining ring through use of an adhesive, press-fit connectors, injection molding, overmolding, or ultrasonic welding.

6. A retaining ring for chemical mechanical polishing comprising:

a substantially annular retaining ring having an upper portion, a lower portion, an inner portion and an outer portion; wherein said upper portion is configured with a plurality of grooves wherein each of said grooves is elliptical and said lower portion is adapted to contact a polishing pad and a semiconductor wafer during polishing; and inserts substantially the same shape as said grooves fixably insertable into said grooves, wherein an opening in said inserts allows a fastener to be passed therethrough to secure said retaining ring to a carrier head, and wherein said openings do not penetrate said lower portion;

said insert having a main body portion and a raised portion, said main body portion having a top side, a bottom side, and a main body edge; wherein an opening is located along an axis through said main body portion and said raised portion such that said raised portion is configured cylindrically around said axis and said main body edge is configured elliptically around said axis.

7. The retaining ring of claim 6, wherein said opening is convex.

8. The retaining ring of claim 6, wherein said opening is concave.

* * * * *